US005458745A

United States Patent [19]

Hradil

[11] Patent Number: 5,458,745

[45] Date of Patent: Oct. 17, 1995

[54] METHOD FOR REMOVAL OF TECHNETIUM FROM RADIO-CONTAMINATED METAL

[75] Inventor: George Hradil, Providence, R.I.

[73] Assignee: Covofinish Co., Inc., Pascoag, R.I.

[21] Appl. No.: 376,791

[22] Filed: Jan. 23, 1995

[51] Int. Cl.[6] ..... C25C 1/06

[52] U.S. Cl. ..... 204/105 R; 204/109; 204/112; 205/85; 423/2; 423/11; 423/49; 423/50

[58] Field of Search ..... 205/85; 204/105 R, 204/109, 112, 151; 423/2, 11, 49, 50

[56] References Cited

U.S. PATENT DOCUMENTS

| | | | |
|---|---|---|---|
| 3,117,000 | 1/1964 | Schlain | 75/109 |
| 3,432,410 | 3/1969 | Cmenot | 204/112 |
| 3,902,896 | 9/1975 | Borbely et al. | 75/109 |
| 3,928,153 | 12/1975 | Gendron et al. | 204/112 |
| 4,792,385 | 12/1988 | Snyder et al. | 204/140 |
| 5,156,722 | 10/1992 | Snyder et al. | 204/112 |
| 5,183,541 | 2/1993 | Snyder et al. | 204/105 R |
| 5,217,585 | 6/1993 | Snyder et al. | 204/112 |
| 5,262,019 | 11/1993 | Snyder et al. | 204/105 R |

OTHER PUBLICATIONS

Journal of Chemical Education Apr., 1951, pp. 189 and 190.

*Primary Examiner*—John Niebling
*Assistant Examiner*—Arun S. Phasge
*Attorney, Agent, or Firm*—Ira S. Dorman

[57] ABSTRACT

Technetium is separated from radio-contaminated metal in a three-step process. The contaminated metal is dissolved in an acid solution; the technetium, present in the resultant solution as pertechnetate ions, is quantitatively reduced to its metallic state through a metal displacement (cementation) reaction with a base metal of lower reduction potential; and the desired metal is electrolytically recovered from the solution, substantially free from technetium contamination.

11 Claims, 1 Drawing Sheet

METHOD FOR REMOVAL OF TECHNETIUM FROM RADIO-CONTAMINATED METAL

The present invention relates to the decontamiation of radio-contaminated metals and, more specifically, to the decontamination of high purity nickel containing trace amounts of technetium 99, as well as uranium and other actinides.

BACKGROUND OF THE INVENTION

The international criterion for the release of radio-contaminated material to non-regulated markets is a maximum activity of 74 Bq/g, with some countries having set even lower limits of activity. In its unpurified state, contaminated nickel may have an activity upwards of 5000 Bq/g, due to the technetium content alone. The decontamination method described and claimed herein is effective to reduce the beta-activity of such materials to levels at which it can be released to non-regulated markets. It applies equally as well to decontaminating copper, cobalt, zinc, and other metals that can be electrolytically deposited from aqueous solutions.

Many processes for the purification and/or decontamination of nickel are known in the art; electrowinning, or electro-refining, is perhaps the most economically advantageous, and is widely used for the purification of non-radioactive nickel. The following are representive of U.S. patents that describe electrowinning processes for the selective deposition of metal from aqueous solutions: U.S. Pat. Nos. 3,853,725; 3,915,828; 4,011,151; 4,146,438; 4,401,532; 4,481,089; 4,537,666; 4,615,776 and 4,792,385.

Electro-refining using aqueous acid electrolytes is known to be effective for the removal of actinides from contaminated nickel; in such a technique the nickel is deposited selectively on a cathode, with the actinide ions remaining in solution due to their lower electrochemical reduction potential. Conventional electro-refining is however ineffective for reducing technetium concentrations in nickel; technetium is found to co-deposit with nickel at the cathode in a ratio that is the same as, or higher than, that in which it is found in the electrolyte.

In U.S. Pat. No. 5,262,019, Snyder et al address the foregoing problem by providing an electro-refining process with separate electrolytic dissolution and electrowinning steps. Contaminated nickel is first electrolytically dissolved in a sulfuric acid electrolyte, followed by treatment of the filtered nickel-laden electrolyte with an ion exchange resin to remove pertechnetate and other ions; the treated electrolyte is then processed in an electrowinning cell to deposit purified nickel at the cathode.

U.S. Pat. No. 5,217,585, also to Snyder et al, describes an electrorefining process in which the technetium-containing nickel is again electrolytically dissolved in an acid electrolyte. The electrolyte is contacted with activated carbon to absorb pertechnetate ions, after which the solution is filtered and transferred to an electrowinning cell, where the nickel is recovered at the cathode. The contaminated carbon is subsequently incinerated to produce technetium-containing ash, which can be encapsulated for disposal.

A technique in which solvent extraction is combined with electrorefining is described in Snyder et al U.S. Pat. No. 5,156,722. Solvent extraction is used to separate heptavalent technetium from the electrolyte in which radio-contaminated nickel is dissolved, followed by electrowinning to recover the nickel.

The process described in Snyder et al U.S. Pat. No. 5,183,541 (as well as in that of U.S. Pat. No. 5,156,722) employs an electro-refining cell that utilizes a semi-permeable membrane. Technetium is chemically precipitated in the anodic compartment, using a variety of agents to reduce it to its tetravalent state, and is removed by filtration. An hydrochloric acid-based electrolyte is used because it is more amenable than sulfuric acid to the chemical precipitation of technetium.

SUMMARY OF THE INVENTION

It is the broad object of the present invention to provide a novel method for the removal of technetium from radio-contaminated metals, which method is highly effective and efficient and is relatively facile to carry out.

A more specific object of the invention is to provide such a method which is readily carried out on a continuous basis, and is especially well-suited for the decontamination of radio-contaminated nickel.

It has now been found that the foregoing and related objects of the invention are attained by the provision of a method in which, as an initial step, a metal contaminated with technetium is dissolved in an aqueous acid solution to produce a process solution containing metal and pertechnetate ions. The process solution is contacted with a solid metal (referred to herein as a "base" metal) that has a reduction potential below that of technetium, and is in a high surface area form, so as to effect reduction of the pertechnetate ions and deposition of metallic technetium on the surface of the base metal, through displacement reactions (i.e., cementation). A decontaminated solution containing ions of the base metal is thereby produced, from which recovery of metal values is effected.

In accordance with more specific embodiments, the method may include the further steps of providing an electro-refining cell having cathodic and anodic compartments, separated by either a semi-permeable membrane or a cationic, ion-selective membrane. The aqueous acid solution, used as the anolyte, is continuously passed from the anodic compartment, through a mass of base metal, and into the cathodic compartment. Electric current, applied to an anode (of the contaminated metal) and a cathode, immersed in the aqueous acid solution, effects dissolution of the anode and deposition upon the cathode of metal values from the decontaminated solution. Generally, a portion of the anolyte will be returned from the mass of base metal to the anodic compartment. When the cell employes a semi-permeable membrane, the liquid level in the cathodic compartment will desirably be maintained at a higher level than in the anodic compartment; the resultant hydrostatic pressure differential will force the aqueous solution through the membrane, passing from the cathodic compartment to the anodic compartment.

DETAILED DESCRIPTION OF THE PREFERRED AND ILLUSTRATED EMBODIMENTS

Figure 1:
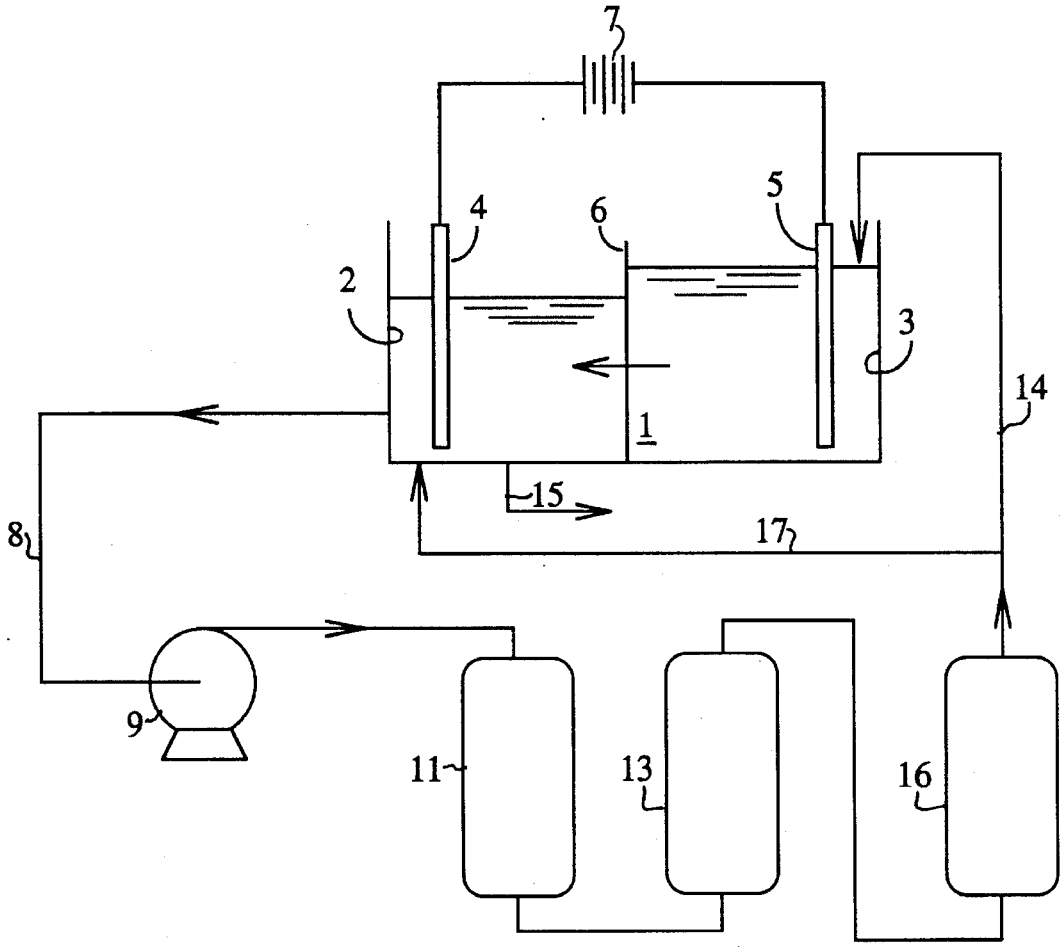
FIG. 1 is a schematic representation of a system suitable for use in carrying out the method of the present invention.

To best understand the electrolytic separation of nickel and technetium, the oxidation/reduction potentials of those elements should be considered. In an acidic solution, technetium exists predominantly in a heptavalent form, as pertechnetate ions ($TcO_4^-$), and nickel exists as $Ni^{++}$. The reduction of these ions to the metallic state is governed by the following half reactions:

$$TcO_4^- + 8H^+ + 7e^- = Tc + 4H_2O \quad e^\circ = .477V$$

$$Ni^{++} + 2e^- = Ni \quad e^\circ = -.250V$$

The magnitude of the standard potential indicates the driving force of the reaction to proceed from left to right. Therefore, the pertechnetate ions are more readily reduced to the metallic state than are the nickel ions. Additionally, the standard potentials indicate that metallic nickel will act as a strong reducing agent with respect to pertechnetate ions. Combining the two foregoing half-reaction equations yields the following reaction:

$$2TcO_4^- + 16H^+ + 7Ni = 7Ni^{++} + 2Tc + 8H_2O \quad \Delta e^\circ = .727\ V$$

This is a metal displacement reaction, which occurs spontaneously when metallic nickel is in contact with an acidic solution containing pertechnetate ions. The reduction of pertechnetate ions has been reported not only with nickel but also with copper, zinc, lead, mercury and tin ("The Electrodeposition of Element 43 and the Standard Potential of the Reaction Ma-$MaO_4^-$," John F. Flagg and William. E. Bleidner, *J. Chem. Phys.*, 13, No. 7, 1945), each of which has a reduction potential less than that of technetium. This reaction is the reason why technetium is always codeposited with nickel when it is present in the cathodic electrolyte.

The equilibrium constant for the foregoing reaction can be determined from the Nernst equation:

$$\Delta e = \Delta e^\circ - (.059/n) \log [Ni^{++}]^7/[H^+]^{16}[TcO_4^-]^2$$

wherein n is the number of electrons (14 in this case ) transferred. At equilibrium, de=0, and the equilibrium constant can be expressed as:

$$k = [Ni^{++}]^7/[H^+]^{16}[TcO_4^-]^2$$

$$\Delta e^\circ = (.059/n) \log k$$

$$\log k = n\ \Delta e^\circ/.059$$

$$k = 10^{(n\ \Delta e^\circ/0.059)}$$

$$k = 10^{(14\times0.727/0.059)} = 3.22\times10^{172}$$

$$[TcO_{4-}] = ([Ni^{++}]^7/3.22\times10^{172}[H^+]^{16})^{1/2}$$

In a typical sulfate-based electrolyte, the nickel concentration would be about 1 M and the pH would be about 4 ($[H^+]$= 0.0001 M). This yields a pertechnetate concentration of $5.5\times10^{-55}$ M. Thus, for all practical purposes the displacement reaction can be considered to go to completion, such that the removal of technetium is quantitative.

The level of technetium contamination in feedstock nickel is typically 0.3 ppm, which is approximately 1 g of technetium for every 3300 kg of feedstock nickel. In the displacement reaction, 2 moles of technetium are reduced for every 7 moles of nickel oxidized; to reduce 1 g of technetium, therefore, 2 g of nickel would be dissolved.

Since the displacement reaction tends to encapsulate the reducing metal, it is beneficial to use a powder, or other high surface area medium, to maximize the surface area and, in turn, technetium loading on the metal. In metal-displacement reactions, the metal ion subjected to reduction forms a metallic layer approximately 0.25 micron thick before the reaction ceases, due to encapsulation of the base metal. Powdered nickel is widely available in a range of particle sizes, with 5 microns being typical. Assuming a spherical geometry, this provides, as a conservative estimate, a surface area of 1348 $cm^2/g$. A 0.25 micron coating of technetium deposited over the calculated surface area translates to approximately 0.4 g of technetium reduced per gram of powdered nickel. Since approximately 2 grams of nickel are oxidized to reduce 1 gram of technetium, this indicates that the nickel will be almost completely displaced by technetium.

Exemplary of the efficacy of the present invention are the following specific examples:

EXAMPLE ONE

Distilled water, with a pH of 3 and having an initial activity of $3.9\times10^3$ Bq/ml due to the presence of technetium 99 as ammonium pertechnetate, is contacted with 5 g/l of activated nickel powder. The resultant solution, at 25° C., is agitated for 20 minutes to allow sufficient solid-liquid contact for the heterogeneous displacement reaction to proceed. After an additional period of 20 minutes, the solution is settled and the clear solution is decanted. It is found to have an activity of 16 Bq/ml, representing a technetium removal of 99.2%. Allowing the reaction to proceed for a full hour produces an activity level of 7 Bq/ml, representing 99.8% removal.

EXAMPLE TWO

An acid solution (pH 2), containing 5.25 g/l of nickel, as $NiSO_4$, and having an initial activity of $0.935\times10^3$ Bq/ml due to the presence of technetium 99 as ammonium pertechnetate ions, is contacted with 5 g/l of activated nickel powder. The resultant solution, at 25° C., is agitated for 20 minutes to allow sufficient solid-liquid contacting for the heterogeneous displacement reaction to proceed. After an additional period of 20 minutes, the solution is settled and the clear solution is decanted. It is found to have an activity of 5.1 Bq/ml, indicating that 99.43% of the technetium has been removed.

Turning now in greater detail to the appended drawing, FIG. 1 shows a single cell, generally designated by the numeral 1, suitable to use in carrying out an electrorefining process embodying the present invention. Although the decontamination of radio-contaminated nickel is specifically discussed, it will be appreciated that the system illustrated is suitable for carrying out a wide range of decontamination reactions, within the scope of the instant invention.

The depicted cell 1 is divided into cathodic and anodic compartments 3 and 2, respectively, by a semi-permeable membrane 6, which may consist of a chemically impervious cloth. The radio-contaminated metal (e.g., nickel) is employed as the anode 4, which is electrolytically dissolved in a sulfuric acid-based electrolyte contained in the anodic compartment 2. The electrolyte for nickel decontamination will typically comprise 50 to 100 g/l of nickel ion, 65 to 120 g/l of sulfate radical, an effective amount (generally up to 40 g/l) of boric acid as a plating agent, and optionally up to 50 g/l of chloride ion. The pH of the electrolyte will normally be maintained between 1 and 4; a pH value of about 1.5 will generally be optimal in the absence of chloride in the electrolyte, and a pH of 3.0 will generally be optimal if chloride ion is present in significant concentrations. The cell will normally be operated at a solution temperature maintained between 20° C. and 80° C., with 60° C. often producing the best results.

Anolyte is transferred from the anodic compartment 2 by way of line 8 and pump 9, through a filter 11 to remove particulates, and then through a bed 13 of nickel powder, where the pertechnetate ions are reduced to the metallic state. The solution then passes through a second filter 16 to remove any suspended matter, which may include nickel powder carried over from the bed 13. A fraction of the treated solution is returned to the anodic compartment 2 through line 17, with the balance flowing through line 14 to the cathodic compartment 3. In this manner technetium is removed from the anolyte solution on a continuous basis.

The portion of the anolyte solution diverted to the cathodic compartment 3 through line 14 serves to maintain the desired nickel concentration therein, while also maintaining the solution level above the level in the anodic compartment 2. This forces the electrolyte to flow from the cathodic compartment 3 to the anodic compartment 2 through the semi-permeable membrane 6, due to the resultant hydrostatic pressure differential. Because the anolyte diverted to the cathodic compartment has been subjected to the metal displacement reaction in bed 13, and because hydrostatic pressure prevents flow from the anodic chamber 2 to the cathodic chamber 3, the technetium concentration in the catolyte will be maintained at a very low level (e.g., below 10 Bq/ml). The flow of treated anolyte is so proportioned as to maintain the nickel concentration in the cathodic compartment 3 sufficiently high for effective nickel deposition on the cathode 5, which will desirably be of seed nickel or stainless steel construction. Nickel deposited from the catholyte will normally have an activity below 17 Bq/g, and uranium and other actinides will not codeposit due to their low reduction potentials; rather they will accumulate in the electrolyte. Drainage for maintenance and cleaning of the cell may be effected through line 15.

The cell is operated under steady or pulsating direct current, delivered to the electrodes 4 and 5 from the power supply 7, usually at a level of 2 to 6, and preferably 3, volts. Current density will normally be maintained between 50 and 250 $A/ft^2$.

The system will usually be so designed that the liquid will be subjected to intimate contact with the treating metal for a period of about 10 to 30 minutes, so as to allow the displacement reaction to approach equilibrium concentrations. Initially, it may be necessary or desirable to activate the metal surface by acid flushing, such as with concentrated sulfuric acid or sulfurous acid, as taught in U.S. Pat. No. 3,117,000. Particles of any powder employed will generally have a diameter of 2 microns or larger; it is believed however that 5 micron particles will to afford almost complete utilization of the base metal for the displacement reaction, while at the same time minimizing the difficulties that would be encountered in the handling of ultra-fine powders.

Although dissolution of the contaminated metal is preferably effected electrolytically, it may be done chemically, as well. In any event, the acid solution is contacted with a high surface area form of a metal having a reduction potential lower than that of technetium. The technetium, present in the solution as pertechnetate ions, is reduced to its metallic state by way of metal displacement (i.e., cementation) reactions with the base metal, which is dissolved in the essentially technetium-free solution and recovered by electrowinning. As will be appreciated, the instant process eliminates any need for ion exchange, chemical precipitation, and other treatments, together with their inherent problems. The depleted solution from the electrowinning cell may of course be recycled, for use in the dissolution process.

When the radio-contaminated metal is for example nickel, the use of pure nickel to reduce the pertechnetate ions to metallic technetium will be favored, since nickel ions liberated to the solution by the displacement reaction will not act as a contaminate to the electrolyte. Any metal having a reduction potential below that of technetium (such as zinc, tin, lead, copper, and mercury, and mixtures thereof) can however feasibly be employed.

The practice of the present invention also favors the use of a sulfuric acid electrolyte, which may advantageously contain chloride ion, as well as boric acid to minimize anode passivation and improve cathode quality. Other acid electrolytes that may be employed include phosphoric acid, sulfamic acid, hydrochloric acid, hydrofluoric acid and nitric acid; as will be appreciated by those skilled in the art, the electrolyte of preference will depend primarily upon the metal that is to be treated.

A preferred system for carrying out the process of the invention is illustrated in FIG. 1 and has been described in detail hereinabove. Another desirable system employs a purification cell that is divided into anodic and cathodic compartments by an ion-selective (cationic) membrane. In such an embodiment, the anolyte is continuously circulated in a closed loop through a filter and suitable cementation-reaction means (e.g., a powder bed) to remove particulates and technetium from the solution. The cationic membrane allows positively charged ions (e.g., $Ni^{++}$) to pass from the anolyte to the catholyte, while preventing the passage of negatively charged ions (i.e., pertechnetate ions), thereby keeping the catholyte and cathodic nickel deposit substantially free of technetium.

Another arrangement that can desirably be employed in the practice of the invention comprises separate dissolution and electrowinning cells. The radio-contaminated metal is anodically dissolved in an acid electrolyte, with the cathode generating oxygen. When the electrolyte is near saturation it is filtered and contacted with the cementation-reaction metal. The solution is then separated and transferred to an electrowinning cell, in which the purified metal is cathodically reduced while the anode generates hydrogen gas.

The metal-displacement reaction may be carried out in a fixed bed or packed column, a spouted bed, a liquid fluidized bed reactor, a stirred tank, or packed column or other suitable means for effecting contact; the choice is not critical to the invention. Additionally, although the use of metal powder is preferred, other forms of metal that provide sufficient surface area to maintain the cementation reaction, such as mesh, metal wool, foil, shot, and the like, can also be employed if so desired.

Thus, it can be seen that the present invention provides a novel method for the removal of technetium from radio-contaminated metals, which method is highly effective and efficient, and is relatively facile to carry out. The method is desirably effected on a continuous basis, and is especially suited for the decontamination of radio-contaminated nickel.

Having thus described the invention, what is claimed is:

1. A method for decontaminating a desired metal, contaminated with technetium, comprising the steps:

dissolving, in an aqueous acid solution, a desired metal contaminated with technetium, to produce a process solution containing ions of said desired metal and pertechnetate ions;

contacting said process solution with a solid base metal having a reduction potential below that of technetium and being of a high surface area form, such contact effecting reduction of said pertechnetate ions and deposition of metallic technetium on the surface of said base metal, through displacement reactions, to thereby produce a decontaminated solution containing ions of said base metal; and effecting recovery of said desired metal values from said decontaminated solution.

2. The method of claim 1 wherein said desired metal is nickel.

3. The method of claim 2 wherein said base metal is selected from the group consisting of nickel, zinc, tin, lead, copper, mercury, and mixtures thereof.

4. The method of claim 3 wherein said base metal is nickel.

5. The method of claim 2 wherein said acid solution is a solution of sulfuric acid.

6. The method of claim 1 wherein said base metal is in powdered form.

7. The method of claim 1 including the further steps:

providing an electro-refining cell having cathodic and anodic compartments separated by a semi-permeable membrane;

providing a mass of said solid base metal;

providing a cathode in said cathodic compartment;

utilizing said desired metal contaminated with technetium as an anode in said anodic compartment;

utilizing said aqueous acid solution as an anolyte;

continuously passing anolyte from said anodic compartment, through said mass of base metal and into said cathodic compartment; and applying electric current across said anode and cathode, immersed in said aqueous acid solution, to effect dissolution of said anode and deposition of said desired metal from said decontaminated solution upon said cathode.

8. The method of claim 7 wherein a portion of said anolyte exiting said mass of base metal is returned to said anodic compartment.

9. The method of claim 8 wherein the liquid level in said cathodic compartment is maintained at a higher level than in said anodic compartment so as to maintain an hydrostatic pressure differential across said membrane, said differential forcing said aqueous solution from said cathodic compartment to said anodic compartment through said membrane.

10. The method of claim 1 including the further steps:

providing an electro-refining cell having cathodic and anodic compartments separated by a cationic, ion-selective membrane;

providing a mass of said solid base metal;

providing a cathode in said cathodic compartment;

utilizing said desired metal contaminated with technetium as an anode in said anodic compartment;

utilizing said aqueous acid solution as an anolyte;

continuously passing anolyte from said anodic compartment, through said mass of base metal, and into said cathodic compartment; and applying electric current to said anode and cathode, immersed in said aqueous acid solution, to effect dissolution of said anode and deposition of said desired metal from said decontaminated solution upon said cathode.

11. The method of claim 10 wherein a portion of said anolyte exiting said mass of base metal is returned to said anodic compartment.

* * * * *